United States Patent [19]

Nishikawa

[11] 4,412,713

[45] Nov. 1, 1983

[54] SOCKET HAVING MEANS OF NO-LOAD ENGAGING WITH AND RELEASING FROM IC PACKAGE

[75] Inventor: Kinichi Nishikawa, Tokyo, Japan

[73] Assignee: Yamaichi Electric Mfg. Co., Ltd., Tokyo, Japan

[21] Appl. No.: 239,477

[22] Filed: Mar. 2, 1981

[51] Int. Cl.[3] ..... H01R 13/54

[52] U.S. Cl. ..... 339/75 M

[58] Field of Search ..... 339/17 CF, 74 R, 75 MP, 339/75 M

[56] References Cited

U.S. PATENT DOCUMENTS 4,062,617 12/1977 Johnson ..... 339/75 M

FOREIGN PATENT DOCUMENTS 1000554 8/1965 United Kingdom ..... 339/75 M

*Primary Examiner*—Joseph H. McGlynn
*Assistant Examiner*—Timothy V. Eley
*Attorney, Agent, or Firm*—Wenderoth, Lind & Ponack

[57] ABSTRACT

A socket for an IC package includes a base plate normally accommodating two rows of contacts and a movable plate supporting at least one IC package with the lead wires of the IC package passing through rows of through openings. The movable plate is movable between a lead wire release position and a contact engaging position in a horizontal lateral direction which is perpendicular to the direction of the length of the rows of contacts. All the contacts are opened in the lateral direction. Guides on the plates limit the movement of the movable plate to only the lateral direction. Further, the movable plate urges a side surface of the package body so that the throughopenings can be wide enough to accommodate production variables of the package.

1 Claim, 23 Drawing Figures

SOCKET HAVING MEANS OF NO-LOAD ENGAGING WITH AND RELEASING FROM IC PACKAGE

BACKGROUND OF THE INVENTION

The present invention relates to a socket having means for no-load engaging by and releasing of an IC package, and more especially to a socket including a base plate having at least one row of contact receiving vertical openings each accommodating a contact engageable with a lead wire, a movable plate having at least one row of through openings each corresponding to a vertical opening and passing a lead wire of the IC package which is placed on the movable plate and means to move the movable plate between a lead wire released release position and a contact engaging position.

Such a socket is known from Japanese Utility Model Application Publication No. 49978/1977. The movable plate of the socket supports all the wire leads of an IC package in lead wire receiving through holes, and when the movable plate is moved from the release position to the contact engaging position, a lateral urging force is applied directly to the side surfaces of the lead wires and the movable plate is moved parallel with the direction of the row of the vertical openings, i.e., parallel to the direction of the rows of contacts.

Japanese Laid-Open Patent Publication No. 88987/1978 (U.S. patent application Ser. No. 755759, Mark Auriana) also describes a socket of generally similar construction to that of the above described publication.

Because the movable plate moves in the direction of the rows of contacts, there must be a space to allow movement of the corresponding lead wire between the release position and the contact engaging position in each vertical opening of the base plate. As is well known, such an IC package has many lead wires in a row with very narrow spaces therebetween. Thus, the distance between adjacent vertical openings receiving the dead wires is also very small. Because the wall between the vertical openings is also very thin, there is little space to allow movement of the movable plate between the release position and the positive contact engaging position. Thus, there are serious problems in the design of the contact, positive release and positive engagement and bending of a lead wire relative to an adjacent lead wire. These problems affect the design of the IC package and an LSI package, both of which tend to have a large number of lead wires so that it is desirable to reduce the distance between adjacent lead wires.

In the above-mentioned Japanese Utility Model Publication, the movable plate has very small through openings to pass the lead wires and engages the side surface of the lead wire. Thus, the lead wire tends to bend toward the adjacent lead wire due to the side pressure. When one or more lead wires are bent, the IC package is difficult to reinsert, as all the lead wires must align with the through openings of the movable plate.

SUMMARY OF THE INVENTION

Accordingly, the object of the present invention is to eliminate or at least mitigate the above-described problems, and to provide a socket of the above-described type having means to move the movable plate in a horizontal lateral direction which is perpendicular to the direction of the row of contacts.

Another object of the present invention is to provide a socket having means to urge the body of the IC package when the movable plate moves in the horizontal lateral direction between the release and contact engaging positions.

To attain the above-described objects, a socket of the above-described type, according to the present invention, comprises means to limit the movement of the movable plate relative to the base plate only to movement only in a horizontal lateral direction are perpendicular to the direction of the row of vertical openings, and said each contact in the vertical opening is open in the horizontal lateral direction, whereby the movable plate and the IC package with the lead wires integral therewith moves in the lateral direction to effect horizontal lateral movement of the lead wires in the vertical openings of the base plate between a lead wire release position and a contact engaging position.

As there is no obstruction to movement in the lateral direction, desired long range of movement of the movable plate can be adopted, and design problems of the contacts will not occur even if the distance between the lead wires of the IC package is further decreased.

Preferably, the movable plate has means to engage with and urge a body portion of the IC package on the upper surface of the movable plate when the movable plate moves in the lateral direction.

Thus, the through openings of the movable plate can be wide enough to take into account production variables in the production of the IC package. Also, insertion and removal of the IC package is easy even if one or more lead wires are bent.

The invention will be described in more detail hereinafter with reference to the accompanying drawing which is given solely by way of example, in which:

DETAILED DESCRIPTION OF PREFERRED EMBODIMENT

Figure 1:
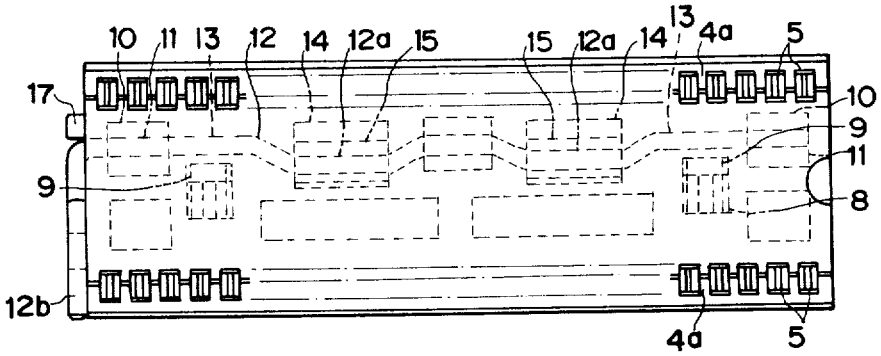
FIG. 1 is a plan view of a socket for IC package according to the present invention.
Figure 2:
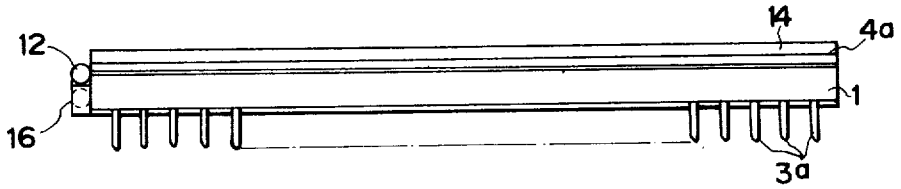
FIG. 2 is a side view of the socket of FIG. 1.
Figure 3:
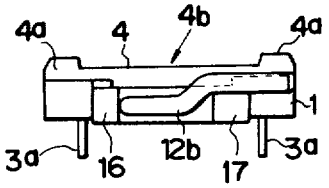
FIG. 3 is a left end view of the socket of FIG. 1.

Referring now to the drawings, an electric connector socket, according to the present invention, comprises a contact mounting base plate 1 of suitable insulating material having two rows of contact receiving vertical openings 2 each of which has a contact 3. A leg 3*a* of each contact 3 therein projects downwardly from the base plate 1 through the opening 2. A movable plate 4 is placed on the base plate 1 and has two rows of through openings 5 each of which is aligned with one of the openings 2 of the base plate 1. The movable plate 4 is movable in a lateral direction perpendicular to the direction of the length of the rows of the contacts 3, as will be described more fully afterwards. At least one circuit element means, e.g., a so-called IC package or LSI package 6 having a plurality of IC lead wires 7 which project downward from both sides of the package, is placed on the movable plate 4 and each of the lead wires 7 passes through a corresponding opening 5 of the movable plate 5 into a corresponding opening 2 of the base plate 1. Each lead wire 7 is engaged with a contact 3 in the opening 2.

Figure 10:
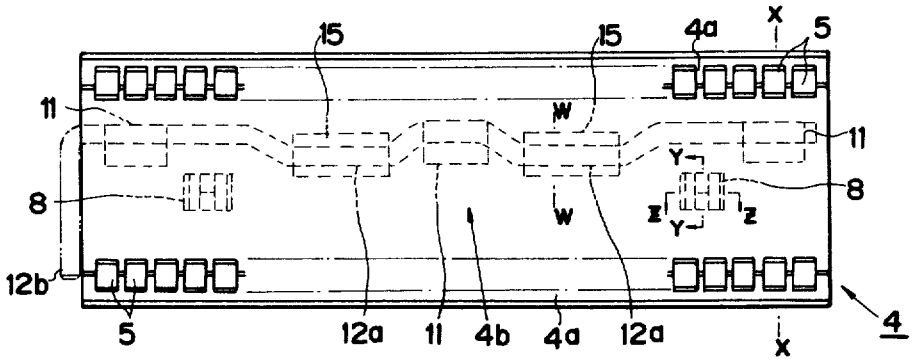
FIG. 10 is a plan view of the movable plate of the socket shown in FIG. 1.
Figure 11:
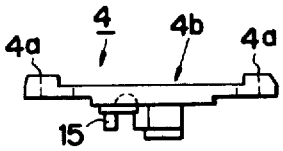
FIG. 11 is a left end view of the plate of FIG. 10.
Figure 12:
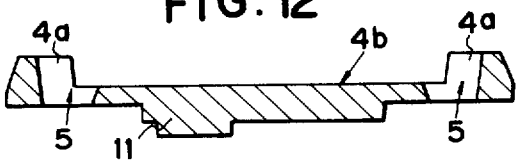
FIG. 12 is an enlarged sectional view along line X—X of FIG. 10.
Figure 13:
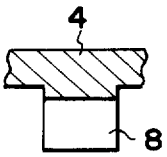
FIG. 13 is an enlarged sectional view of a portion of FIG. 10 along line Y—Y of FIG. 10.
Figure 16:
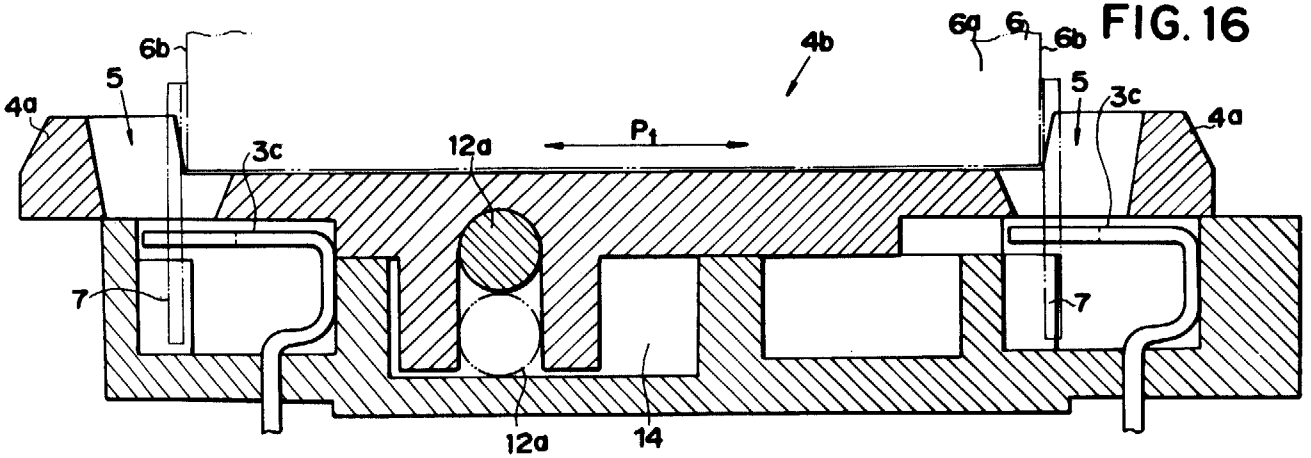
FIG. 16 is an enlarged sectional view of the socket shown in FIG. 1 showing the open or lead wire release position.
Figure 17:
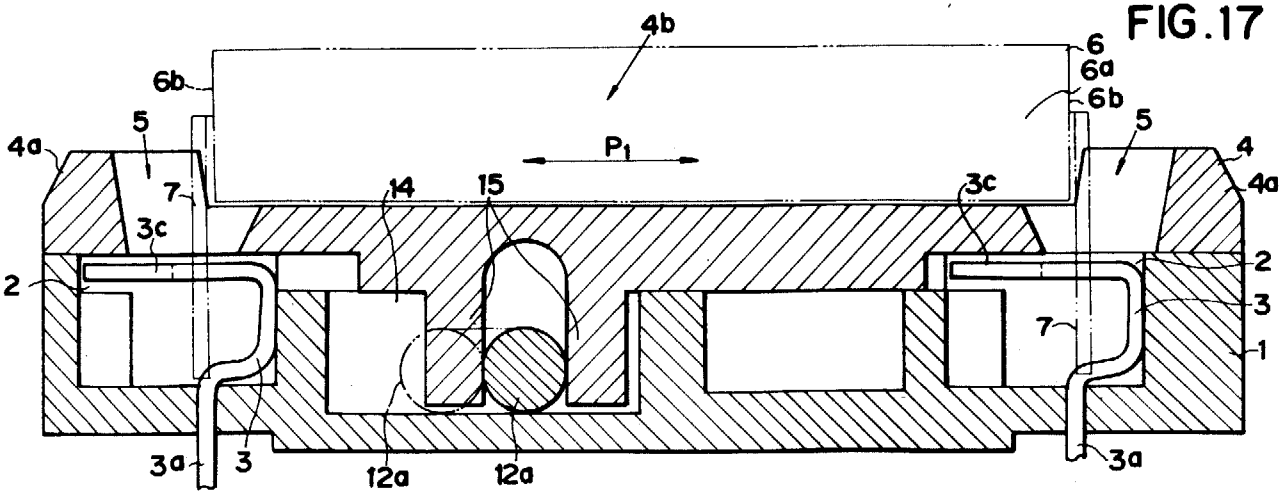
FIG. 17 is an enlarged sectional view of the socket shown in FIG. 1 showing the contact engaging position.

On the upper surface of the movable plate 4, along both side edges of the plate 4 parallel with the longitudinal direction of the rows of the openings 5, upwardly projecting walls 4*a* are formed. Between the walls 4*a*, a plane surface 4*b* is formed as shown in FIGS. 10–12. As shown in FIGS. 16 and 17, the body 6*a* of the IC package 6 is placed on the surface 4*b*, and when the movable plate 4 is moved in the lateral direction $P_1$ shown in FIG. 16, the shoulder portion between the projecting wall 4*a* and the space 4*b* engages with a side edge 6*b* of the body 6*a* of the package 6 and urges the same to the lateral direction $P_1$. Thus, the projecting wall 4*a* acts as IC package engaging wall. The wall 4*a* is formed as a generally continuous wall having a plurality of recesses constituted by the openings 5 in the illustrated embodiment.

Figure 8:
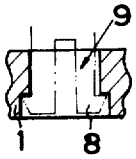
FIG. 8 is an enlarged sectional view of a portion of FIG. 4 along line Z—Z of FIG. 4.
Figure 9:
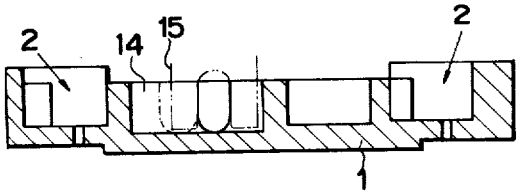
FIG. 9 is an enlarged sectional view along line W—W of FIG. 4.
Figure 14:
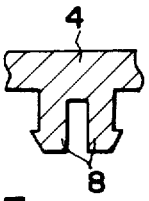
FIG. 14 is an enlarged sectional view of a portion of FIG. 10 along line Z—Z of FIG. 10.

On the lower surface of the movable plate 4, are at least two latch elements 8, shown in FIG. 14, projecting downwards and engaging with retainer grooves 9 formed in the base plate 1 as shown in FIG. 8. Claws of the latch elements 8 engage under downward facing shoulders of the groove 9 and retain the movable plate 4 on the base plate 1. The width of the groove 9 is larger than the width of the latch elements 8 so that the movable plate 4 is slidable to the lateral direction $P_1$ but cannot move longitudinally relative to the base plate 1. The lateral movement of the movable plate 4 may be limited by the width of the groove 9 and the width of the latch element 8. Preferably, the width of the groove 9 is larger than the lateral movement of the movable plate 4 relative to the latch element 8, and the lateral movement is limited by a plurality of slide elements 11 which are formed on lower surface of the movable plate 4 and corresponding grooves 10 formed in the upper surface of the base plate 1. By making the dimensions of the slide element 11 and the groove 10 in the lateral direction $P_1$ accurate the desired contact engaging position and release position of the lead wires 7 of the IC package 6 can be established.

Figure 4:
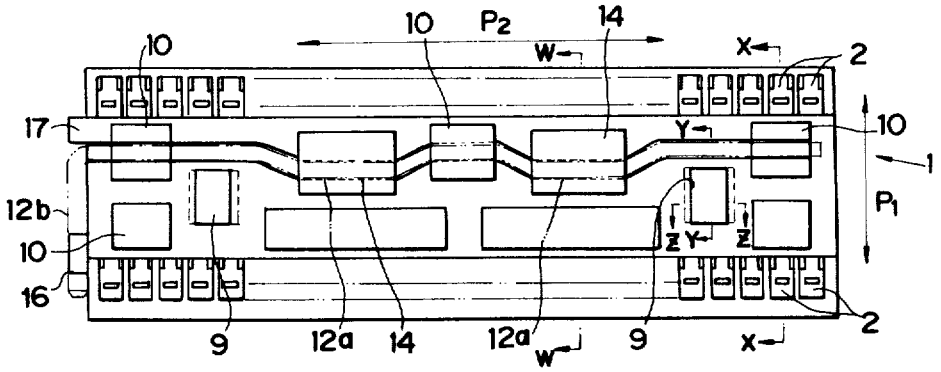
FIG. 4 is a plan view of the base plate of the socket showin in FIG. 1 with contacts therein.
Figure 5:
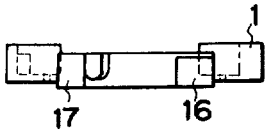
FIG. 5 is a left end view of the base plate of FIG. 4.
Figure 6:
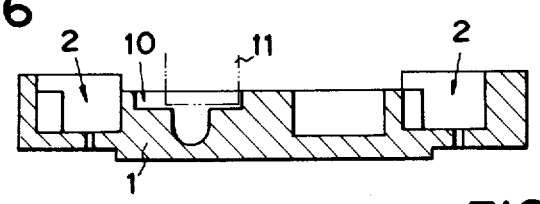
FIG. 6 is a sectional view, on an enlarged scale, along line X—X of FIG. 4.
Figure 7:
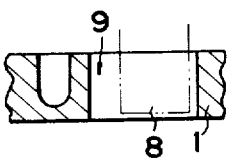
FIG. 7 is an enlarged sectional view of a portion of FIG. 4 along line Y—Y of FIG. 4.
Figure 15:
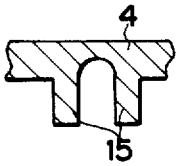
FIG. 15 is an enlarged sectional view of a portion of FIG. 10 along line W—W of FIG. 10.
Figure 23:
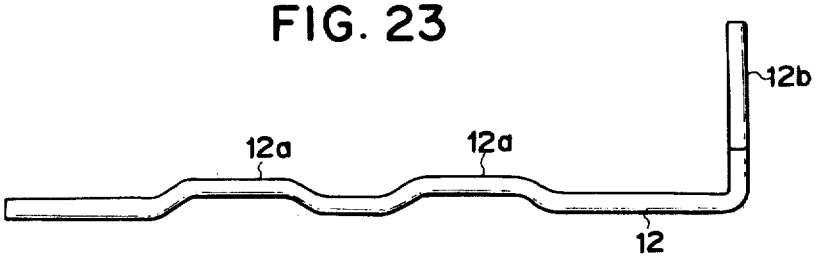
FIG. 23 is a side view of the lever of the socket shown in FIG. 1.

To displace the movable plate 4 manually in the lateral direction $P_1$ between the contact engaging position and the release position relative to the base plate 1, the socket according to the present invention includes a lever 12. The lever 12 is shown in FIG. 23 and extends in the longitudinal direction $P_2$ shown in FIG. 4 between the movable plate 4 and the base plate 1. As shown in FIG. 4, the lever 12 is rotatably supported in bearing grooves 13 formed in the upper surface of the base plate 1 and has eccentric portions 12*a* which are received in lever operating spaces 14 also formed in the upper surface of the base plate 1. Lever engaging elements 15 shown in FIGS. 10 and 15 engage with the eccentric portions 12*a* of the lever 12 in the lever operating spaces 14. The lever engaging elements 15 are formed on lower surface of the movable plate 4. One end of the lever 12 is bent perpendicular outside of the socket to form a operating handle 12*b*. Thus, by rotating the bandle 12*b* manually, the eccentric portions 12*a* displace laterally in the plan view shown in FIGS. 4 and 10, and more the lever engaging elements 15 so that the movable plate 4 which is integral with the elements 15 is also displaced relative to the base plate 1 in the lateral direction $P_1$ between contact engaging position and of FIG. 17 and the release position of FIG. 16. Stops 16 and 17 may be formed on the corresponding end surface of the base plate 1 to limit the rotation of the lever 12.

The contact 3 which is mounted in each of the contact receiving vertical openings 2 formed in the base plate 1 is shown in FIGS. 18–22. The contact 3 is formed from a metal plate and includes a leg 3*a* and a pair of bent and forked contact elements 3*c* which extend horizontally when the leg 3*a* extends vertically. Between the contact elements 3*c*, a contact clearance 3*b* is formed, and the open end portion of the clearance 3*b* is enlarged to form enlarged end portion 3*e*. Between the horizontal contact elements 3*c* and the leg 3*a*, bent portions 3*d* are formed and the forked portion extends from the horizontal contact elements through the bent portions 3*d* sufficiently downwards to obtain desired elasticity of the contact elements. As shown in FIGS. 16 and 17, all the contacts 3 are mounted in the openings 2 such that the enlarged end portions 3*e* between the contact elements 3*c* are directed in one direction so that the enlarged end portions 3*e* are aligned on two lines which are parallel with the longitudinal direction $P_2$.

To assemble the socket, all the contacts 3 are inserted in the openings 2 to cause the legs 3*a* to project downwards through the openings 2 and the contact elements 3*c* are directed in the lateral direction $P_1$, as shown in FIGS. 16 and 17. Then the lever 12 is placed on the base plate 1 such that the lever 12 is in the bearing grooves 13. Then the movable plate 4 is placed on the base plate 1 to engage the slide elements 11 in the grooves 10, the latch elements 8 in the grooves 9, and the lever engaging elements 15 with the eccentric portions 12*a*. By pressing the movable plate 4 downwardly, the claws of the latch elements 8 engage under the shoulders of the grooves 9 and permanently retain the movable plate 4 against disassembly. Thus, the movable plate 4 can be moved relative to the base plate 1 by rotating the handle 12 only in the lateral direction $P_1$.

Figure 18:
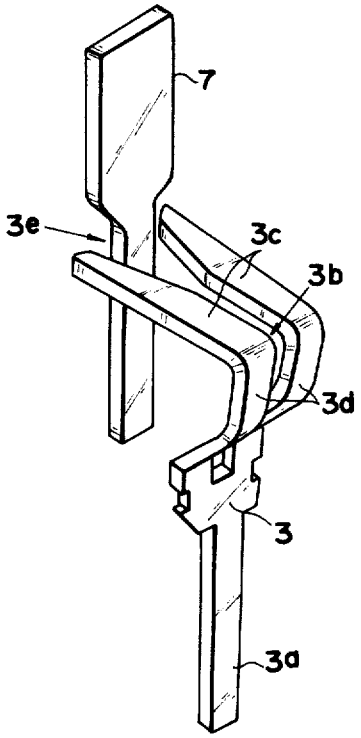
FIGS. 18 and 19 are enlarged perspective views of the lead wire and the contact showing the open or release position and the contact engaging position respectively.
Figure 19:
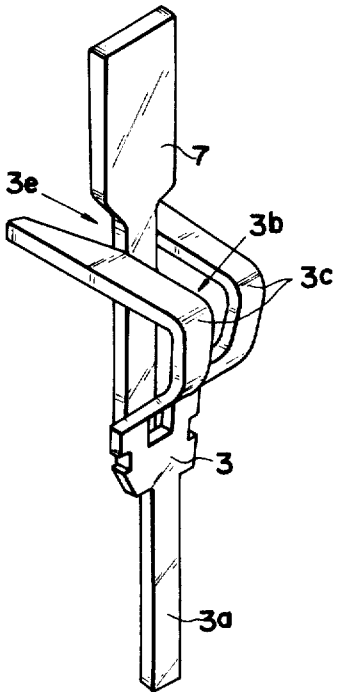
Figure 20:
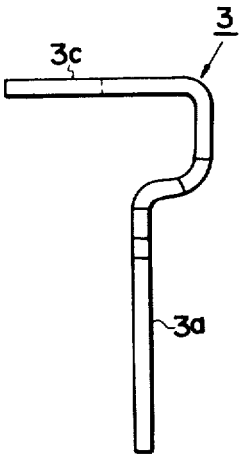
FIG. 20 is a side view of the contact shown in FIGS. 18 and 19.
Figure 21:
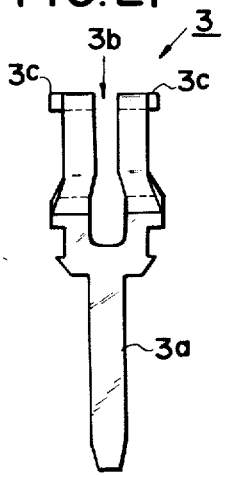
FIG. 21 is a right end view of the contact of FIG. 20.
Figure 22:
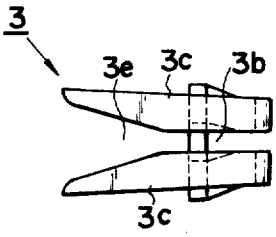
FIG. 22 is a plan view of the contact of FIG. 20.

To mount the IC package 6, the movable plate 4 is moved in the lateral direction $P_1$ by operating the handle 12*b* of the operating lever 12 to the open position so that the openings 5 of the movable plate 4 are aligned vertically with the enlarged end portions 3*e* between the contact elements 3*c* of the contacts 3 which are in the openings 2 of the base plate 1. Then the IC package 6 is placed on the surface 4*b* between the upwardly projecting walls 4*a* of the movable plate 4. The lead wires 7 of the IC package 6 are inserted through the openings 5 of the movable plate 4 into the openings 2 of the base plate 1. As shown in FIGS. 16 and 18, the lead wires 7 pass freely between the contact elements 3*c* at the enlarged end portions 3*e* so that the IC package 6 can be placed on the movable plate 4 without exerting any force on it until the bottom surface of the body 6*a* of the IC package 6 contacts the upper surface of the space 4*b* of the movable plate 4. Then, the handle 12*b* of the lever 12 is rotated to the contact engaging position to move the movable plate 4 in the lateral direction. The side surface of one of the upwardly projecting walls 4*a* engages with the side surface 6*b* of the body 6*a* of the IC package 6 and urges the same in the lateral direction $P_1$. Thus the lead wires 7 are urged laterally and are moved sidewise in the clearances 3*b* between the contact elements 3*c*, as shown in FIGS. 17 and 19, against the elasticity of the contact elements 3*c*. Consequently all the lead wires 7 of the IC package 6 are elastically gripped by the contacts 3 and superior electrical connections between the lead wires 7 and the contacts 3 are obtained. The IC package 6 is firmly retained on the movable plate 4 and no other retainer is necessary.

To remove the IC package 6 from the socket, the handle 12*b* is rotated to the open position. The movable plate 4 is moved laterally and the side wall of the other upwardly projecting wall 4*a* urges the opposite side surface of the body 6*a* of the IC package 6. Thus the lead wires 7 of the IC package 6 move sidewise in the contact clearance 3*b* of the contact elements 3*c* until the lead wires 7 are free from the contact elements 3*c* in the enlarged end portions 3*e*. Thus, as the lead wires 7 are not gripped by the contact elements 3*c*, the IC package 6 can be removed without any force from the socket.

The lever 12 which acts as the operating mechanism to move the movable plate 4 between the engaging and open positions is known in itself. The operating mechanism may be any known desired means. For example, the movable plate 4 may be urged directly by the assembly workers fingers or may be urged by a driver as shown in the Japanese Patent Laid-open Publication No. 53-88987.

The contact receiving vertical openings 2 of the base plate 1 are extended in the lateral direction $P_1$ to allow lateral sidewise displacement of the lead wires 7 of the IC package 6. The through openings 5 of the movable plate 4 are substantially larger than the diameter of the lead wires 7 of the IC package 6 in the illustrated preferred embodiment of the present invention. Thus, the lead wires 7 freely pass through the openings 5 into the vertical openings 2 of the base plate 1. Conventionally, such openings in the movable plate have a generally similar diameter to that of the lead wires to support and urge the side surface of the lead wires to engage the lead wires with contacts on the base plate. By urging the side surface 6*b* of the body 6*a* of the IC package 6 by engaging it with the projecting wall 4*a* of the movable plate 4, according to the present invention, the lead wires 7 are not urged directly by the movable plate 4. As the dimension of the openings 5 is sufficiently larger than that of the lead wires 7, the lead wires can be freely inserted and removed without disturbance. Further, even when the position and alignment, and dimension of the lead wires 7 are different from each other in different IC packages, such package can be mounted on the socket as long as the lead wires pass into the enlarged end portions 3*e* of the contacts 3. Thus, interchangeability is greatly improved.

It will be appreciated that the socket according to the present invention allows no load mounting and removing of the IC package. Because the movable plate 4 and the lead wires 7 of the IC package 6 move in the lateral direction $P_1$, i.e., perpendicular to the direction of the length of the rows of contacts, other remarkable advantages are attained. To obtain the contact engaging position and the open or release position by sidewise displacement of the lead wires 7 and the IC package, sufficient size of the vertical openings 2 is necessary to allow such displacement of the lead wires. As to the longitudinal direction along the rows of contacts, which is the common direction of displacement of conventional socket, such dimension is limited by the thickness of the walls between the vertical openings. Because the movable plate 4 and the lead wires move laterally of the direction of the length of the rows of contacts, the desired dimension of the vertical openings 2 to allow the desired sidewise displacement of the lead wires 7 can be obtained. As limitation of the sidewise displacement is not necessary, the contact 3 can be very easily designed as to the dimension, contact area and strength thereof. Because the lead wires 7 of the IC package 6 are loaded uniformly, no sidewise deflection of the lead wire by lateral over load is caused so that distances between the lead wires are constant.

The movable plate 4 urges the body of the IC package 6 in the lateral direction to engage and disengage the lead wires and the contacts according to the present invention. Because the lead wires do not receive a sidewise urging force in the longitudinal direction of the rows of contacts, inclination and deformation of the lead wires relative to adjacent lead wires does not occur. Further, because the through openings 5 of the movable plate 4 do not act as sidewise urging elements for the lead wires 7, the openings 5 can be made sufficiently large to allow free passage of the lead wires. Thus, insertion and removal of the IC package is easy and strict accuracy of the formation of the openings 5 is not necessary so that the socket can be made inexpensively. Also the socket can be accommodated to production variables of IC packages as to dimension and shape of the lead wires.

One preferred embodiment of the present invention is described in detail. Many variations can be made without departing from the scope of the present invention. For example, the contact may be a straight bent plate having lateral open ends or a pair of straight or formed metal plates having one or both lateral enlarged end portions therebetween to receive a laterally moving lead wire. Also the projecting walls to urge the body of the IC package may be a number of pins or lugs projected from the movable plate.

What is claimed is:

1. A socket for a substantially rectangular IC package having lengthwise extending parallel rows of depending lead wires, said socket comprising:

a rectangular base plate having two lengthwise extending parallel rows of contact receiving vertical openings with the rows spaced the same distance as the rows of lead wires and with the openings in the rows spaced at the same distance apart as the leads on said IC package, and each opening having a contact therein for being engaged by a corresponding lead wire from the IC package when the IC package is assembled with the socket;

a substantially rectangular movable plate having two lengthwise extending parallel rows of through openings corresponding with the rows of vertical openings in said base plate and having the through openings aligned with the corresponding vertical openings in the base plate, said through holes and said vertical openings having a larger cross-section than the depending lead wires on the IC package for permitting the lead wires to pass freely through said through holes and into said vertical openings when the IC package is assembled with the socket, said movable plate being movably mounted on said base plate for movement only in a direction transversely to the length of said rows of openings and through holes; and means for moving said movable plate on said base plate in said direction between a lead wire released position in which the lead wires are out of contact with said contacts and a lead wire engaged position in which the lead wires are engaged with said contacts, each contact opening in the direction toward the direction from which said movable plate is moved by said moving means toward said contact engaged position, said movable plate further having two parallel lengthwise extending walls thereon extending parallel to said rows of openings and spaced a distance from each other equal to the width of the IC package, whereby when the IC package is assembled with the socket, the IC package is placed between said walls and the force exerted on the IC package and the depending lead wire during the movement of said movable plate is solely through the sides of the IC package.

* * * * *